US008403421B2

(12) United States Patent
Wang

(10) Patent No.: US 8,403,421 B2
(45) Date of Patent: Mar. 26, 2013

(54) SINGLE FRAME SLING CHAIR

(75) Inventor: Oliver Wang, Millbrae, CA (US)

(73) Assignee: Agio International Company, Ltd., Hong Kong (HK)

( * ) Notice: Subject to any disclaimer, the term of this patent is extended or adjusted under 35 U.S.C. 154(b) by 442 days.

(21) Appl. No.: 12/800,275

(22) Filed: May 12, 2010

(65) Prior Publication Data

US 2010/0270843 A1 Oct. 28, 2010

Related U.S. Application Data

(63) Continuation-in-part of application No. 12/217,446, filed on Jul. 3, 2008, now Pat. No. 7,731,291, which is a continuation-in-part of application No. 11/193,779, filed on Jul. 29, 2005, now Pat. No. 7,458,641.

(60) Provisional application No. 61/232,233, filed on Aug. 7, 2009.

(51) Int. Cl.
*A47C 7/00* (2006.01)
*A47C 7/02* (2006.01)

(52) U.S. Cl. ..... 297/440.11; 297/452.13; 297/452.56

(58) Field of Classification Search ..... 297/452.13, 297/440.11, 452.56, 452.58, 452.59, 452.6, 297/452.62
See application file for complete search history.

(56) References Cited

U.S. PATENT DOCUMENTS

| | | | | |
|---|---|---|---|---|
| 1,515,711 | A | 11/1924 | Van Hove | |
| 2,275,908 | A | 3/1942 | Kelly | |
| 2,512,353 | A | 6/1950 | Magalthno et al. | |
| 2,786,513 | A | 3/1957 | Hoven et al. | |
| 2,809,692 | A | 10/1957 | Taffe | |
| 3,437,375 | A | 4/1969 | Kettler | |
| 3,677,601 | A | 7/1972 | Morrison et al. | |
| 3,856,353 | A | 12/1974 | Morrison et al. | |
| 4,431,229 | A | 2/1984 | Unger | |
| 4,588,227 | A | 5/1986 | Austin | |
| 4,817,655 | A | 4/1989 | Brooks | |
| 4,848,843 | A | 7/1989 | Gibbs | |
| 5,338,091 | A | 8/1994 | Miller | |
| 5,503,455 | A | 4/1996 | Yang | |
| 5,507,563 | A * | 4/1996 | Arthur, Jr. | 297/440.23 |
| 5,655,812 | A | 8/1997 | Albecker, III | |
| 5,678,890 | A | 10/1997 | Tenbroeck | |
| 5,716,101 | A | 2/1998 | Frinier et al. | |
| 5,911,478 | A | 6/1999 | Goodman | |
| 6,585,323 | B2 | 7/2003 | Gaylord | |
| 6,623,079 | B2 | 9/2003 | Gregory | |
| 6,779,849 | B1 * | 8/2004 | Harper et al. | 297/452.13 |
| 6,783,183 | B2 | 8/2004 | Tseng | |
| 6,880,215 | B2 | 4/2005 | Peterson | |
| 6,899,398 | B2 | 5/2005 | Coffield | |
| 7,125,081 | B2 | 10/2006 | Church | |

(Continued)

OTHER PUBLICATIONS

Casual Deck and Patio Brochure; "How-to Install Replacement sling Fabric"; no date; pagehttp://www.casualdeckandpatio.com/products/howto/install_slings_howto.shtml.

*Primary Examiner* — Sarah B McPartlin
(74) *Attorney, Agent, or Firm* — Williams Mullen

(57) ABSTRACT

A sling chair includes a back frame member having side rails held in substantially parallel relation by a pair of cross bar members. In one embodiment, the cross bar members are generally curved so as to extend away from the back faces of the side rails, forming a concave back structure which can receive a sling member and, eventually, a seated occupant. The cross bar members have a notch allowing for insertion of a flexible rod and sling loop and sling member after assembly of the cross bar members and side rails. Insertion of the flexible rod and sling loop does not require tools. The cross members are adapted to retain the sling member in secure fashion through upper and lower backrest assemblies, resulting in better support and more efficient assembly. This also facilitates separate provisioning of decorative features to improve the chair's aesthetic qualities.

33 Claims, 9 Drawing Sheets

U.S. PATENT DOCUMENTS

| | | | | |
|---|---|---|---|---|
| 7,458,641 | B2 | 12/2008 | Wang | |
| 2003/0071509 | A1 | 4/2003 | Neil et al. | |
| 2003/0160495 | A1 * | 8/2003 | Tarnay et al. | 297/452.13 |
| 2004/0262975 | A1 | 12/2004 | Su | |
| 2005/0146193 | A1 | 7/2005 | Shieh | |
| 2007/0018495 | A1 | 1/2007 | Xiang | |
| 2007/0278840 | A1 * | 12/2007 | Wang | 297/440.11 |

* cited by examiner

SINGLE FRAME SLING CHAIR

CROSS-REFERENCE TO RELATED APPLICATION

This application claims the benefit of U.S. Provisional App. Ser. No. 61/232,233, filed Aug. 7, 2009 and is a continuation-in-part of prior application U.S. application Ser. No. 12/217,446, filed Jul. 3, 2008, now U.S. Pat. No. 7,731,291, which is a continuation-in-part of prior application U.S. application Ser. No. 11/193,779, filed Jul. 29, 2005, now U.S. Pat. No. 7,458,641.

FIELD OF THE INVENTION

The present invention relates to chair constructions, and more particularly relates to a chair construction employing a sling-type backrest which promotes chair stability, comfort and a variety of design alternatives.

BACKGROUND OF THE INVENTION

Various types of sling chairs have been known which provide a somewhat concave and/or giving backrest. Such chairs generally include a back portion and a seat portion, and may optionally include armrest portions. The back portion generally includes a back frame and a flexible yet supportive backrest made of fabric or other suitable material and mounted to the back frame. Different mechanisms have been employed for securing the backrest to the back frame, and these prior art mechanisms have suffered from several deficiencies. First, these prior art mechanisms often fail to provide a secure connection, which can result in the backrest being unsupportive of the seated individual. Second, sling chairs often expose aspects of the sling hardware, such as attachment elements or fasteners, and it would be aesthetically desirable to hide such aspects. Further, the sling backrest for these chairs is frequently retained along the chair side rail supports, creating side-to-side sling tension, restricting the potential to add decorative chair features, and complicating assembly.

SUMMARY OF THE INVENTION

The present invention provides a connection assembly for a sling chair which allows for efficient chair assembly and results in a comfortable yet sturdy chair. The present invention includes a back frame member having side rails held in substantially parallel relation by a pair of cross bar members. In one embodiment, the cross bar members are generally curved so as to extend away from the back faces of the side rails, forming a concave back structure which can receive a sling member and, eventually, a seated occupant. The cross bar members are adapted to retain the sling member in secure fashion through upper and lower backrest assemblies. In this way, the sling member is not secured to the side rails, but rather to the cross bar members, resulting in better support, a more secure connection and more efficient assembly. The method of securing the sling member using a detachable support bar having a scaffold support element ensures that the sling member is efficiently and securely retained. The present invention also facilitates separate provisioning of decorative features to improve the chair's aesthetic qualities.

Another aspect or embodiment is a back for a sling chair. A fabric sling back is used, the sling having a height and width to form an upper end and a lower end, a lateral pocket loop across the lower end of the sling with a loop diameter, with the loop defining at least one side pocket opening at one end. The back includes a pair of side rail members, each having a front and a back face; a flexible securing rod having a length substantially corresponding to the length of the loop and a rod diameter less than the diameter of the loop. A first and second cross bar members inter-relate with the side rail members. A first cross bar member secured to corresponding upper portions of said side rail members, said first cross bar member having a lower surface and a generally curved shape so as to project at least partially outwardly away from said respective back faces of said side rail members; a second cross bar member secured to corresponding lower portions of each of said side rail members and cooperating with said first cross bar member so as to hold said side rail members in substantially parallel relation, said second cross bar member being substantially parallel to said first cross bar member. In this embodiment, the second cross bar member is tubular and has a generally curved shape so as to project at least partially outwardly away from said respective back faces of said side rail members. The second cross bar member defines an internal conduit with a longitudinal slot opening on a face of the second cross bar member. This slot has a width that is greater than the thickness of the fabric of the sling and less than the diameter of the flexible securing rod; the slot further having a length at least about the width of the fabric sling. The conduit has a diameter greater than the flexible rod and twice the thickness of the fabric of the sling, the conduit thus being configured to retain the rod when inserted into the lateral pocket loop and the conduit. The second cross bar member further includes at least one access notch along the longitudinal slot opening into the conduit, formed by a widening of the slot on the face of the second cross bar member, wherein the access notch is at least as wide as the flexible rod, and further wherein the notch is long and wide enough to enable the insertion of the sling lateral pocket loop into the conduit and the insertion of the securing rod into the sling loop while the sling loop is inserted into the conduit. The notch is located at a point along the slot that substantially corresponds to the pocket opening when the sling loop is substantially inserted into the conduit. A support bar member may be secured to the first cross bar member. This support bar member may have an upper surface and being substantially curved so as to extend in an arc pattern substantially similar to said first cross bar member, with the support bar member being secured such that a gap is created between the lower surface of the first cross bar member and the upper surface of the support bar member extending from an inside surface of each all the way through to an outside surface of each.

DETAILED DESCRIPTION OF THE PREFERRED EMBODIMENTS

Figure 1:
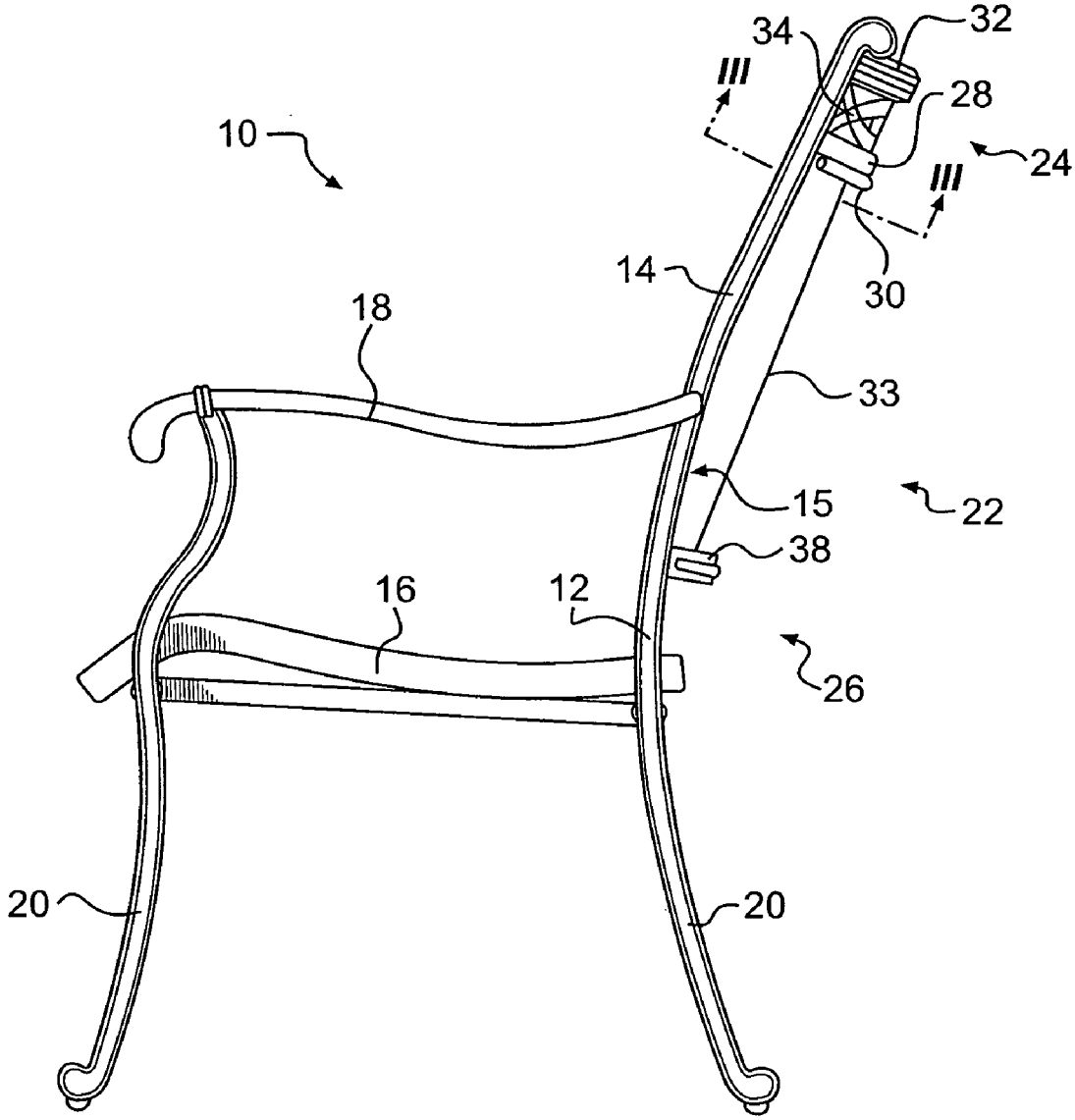
FIG. 1 is a right side view of an exemplary chair showing one embodiment of the present invention.
Figure 2:
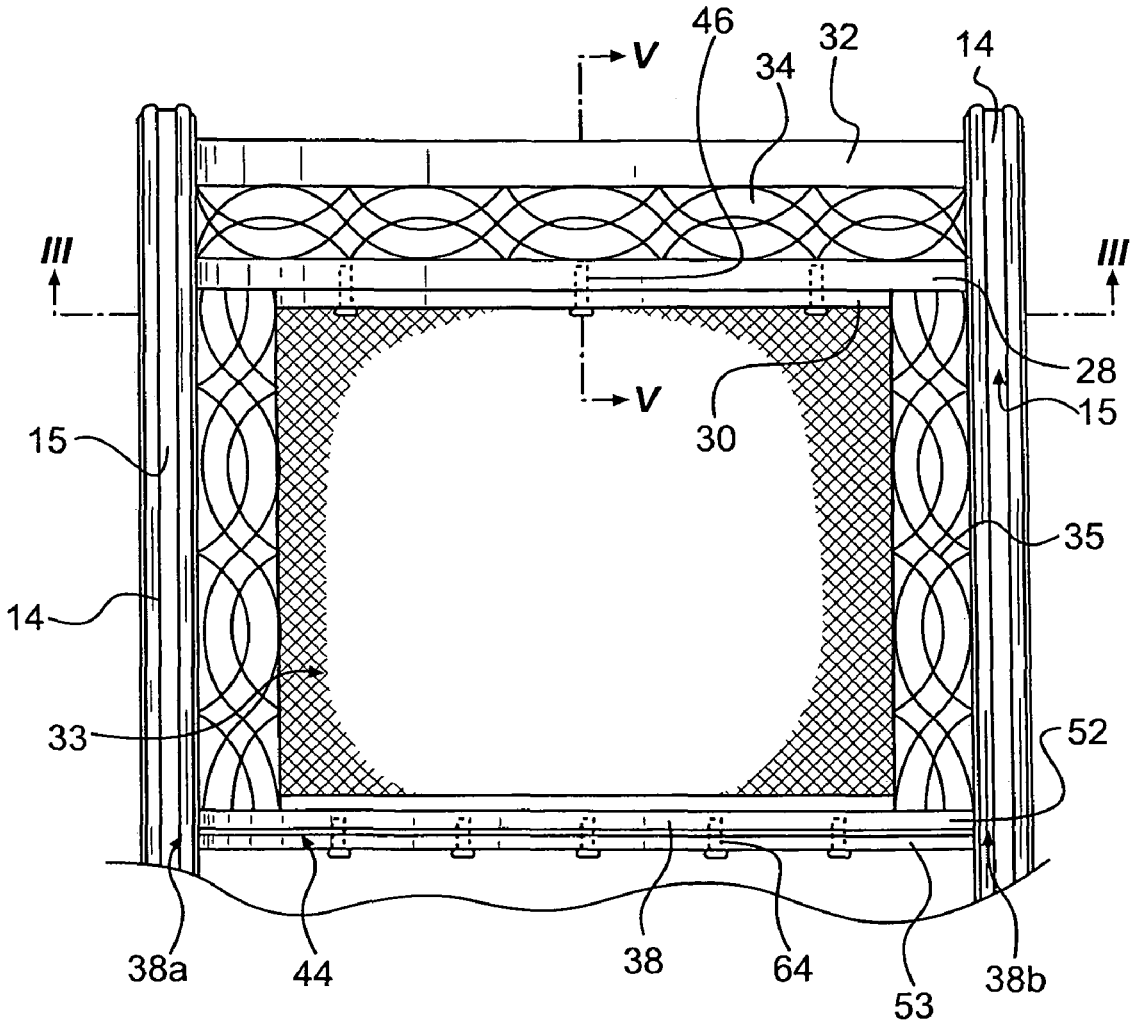
FIG. 2 is a rear elevation view of the back frame and backrest elements of the chair assembly of the present invention.

As shown in FIGS. 1 through 10, the present invention provides a single frame sling chair 10, having a rigid frame 12. FIG. 1 shows an overall, right side view of one embodiment of a chair according to the present invention, including rigid frame 12 comprising frame side rails 14, seat 16, armrests 18 and leg portions 20. A backrest assembly 22 is also shown, including upper backrest assembly 24 and lower backrest assembly 26. Upper backrest assembly portion 24 includes top cross bar 28 and support bar 30 that may be detachable, described more completely hereafter. Top cross bar 28 may be integrally formed with top element 32 and connective fascia 34, or may be secured to top element 32 and connective fascia 34 as separate members. Top cross bar 28 is secured to an upper inner portion of the side rails, and acts as a spreader between the frame side rails 14. The bottom cross bar 38 is secured to a lower inner portion of the side rails, and acts in concert with the top cross bar 28 as a spreader between the frame side rails 14, as shown in FIG. 2. Lower backrest assembly portion 26 may take a variety of forms, as detailed further herein.

As shown in FIGS. 1 and 2, one version of lower backrest assembly portion 26 includes bottom cross bar 38 which is secured to frame side rails 14 and acts as a spreader to hold frame side rails 14 apart. Bottom cross bar 38 cooperates with top cross bar 28 to hold frame side rails 14 in substantially parallel relation. A backrest, such as a sling fabric member 33, is secured to the upper backrest assembly 24 and lower 26 backrest assembly to provide body support to individuals using the sling chair 10 of the present invention. Sling fabric member 33 may include at least a portion of elastic material which allows for a taut appearing backrest while stretching during installation.

In the embodiment as shown in FIG. 2, top cross bar 28 and bottom cross bar 38 are provided in substantially parallel relation. The top and bottom crossbars 28, 38 are provided of a curved or concave shape generally, and can be solid or hollow. As shown in FIGS. 1 and 2, the top and bottom crossbars 28, 38 project at least partially outwardly away from respective frame side rail back faces 15. The top and bottom crossbars 28, 38 can be any of a variety of section shapes, and can be adapted to accept a decorative connective fascia 34 as part of or an attachment to top cross bar 28, as shown in the exemplary embodiment of FIG. 2. Decorative side castings 35 can also be provided as shown in FIG. 2 so as to flank sling fabric member 33. The sectional shape of frame side rails 14 as well as that of support bar 30 can be circular, oval, square, or other shape, for example. Further, support bar 30 and frame side rails 14 can be solid or hollow.

The remainder of the chair frame can have any arrangement for a seat bottom 16, it may have armrests 18 or no armrests, and it may have any number of leg portions 20, or a pedestal instead of legs, and may be a rocker, swivel chair, swivel-rocker, swivel-glider, or a rigid monolithic frame.

Figure 3:
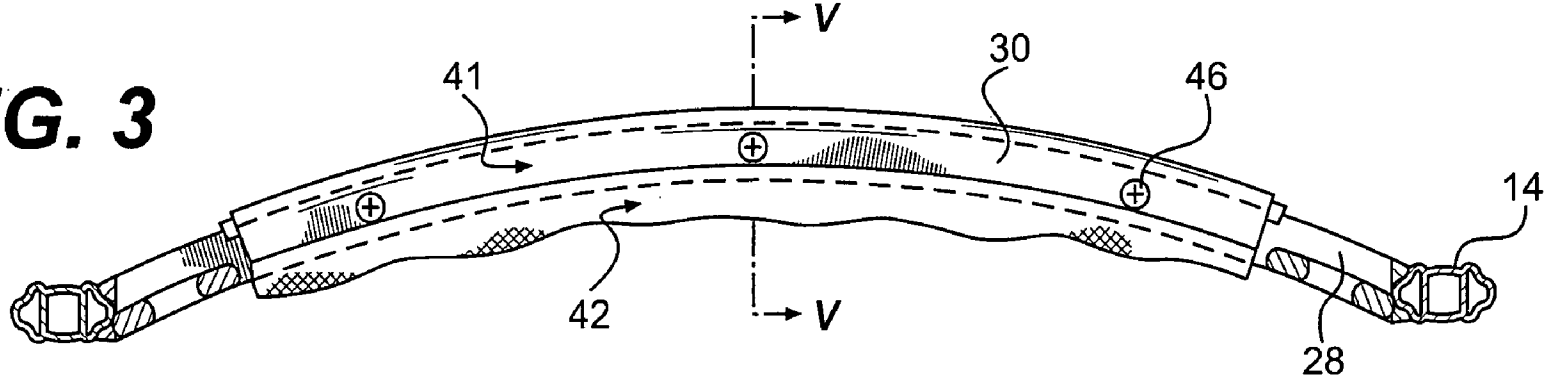
FIG. 3 is a bottom cross-sectional view of the upper backrest assembly of one embodiment of the present invention, taken along the line of FIGS. 1 and 2.
Figure 5:
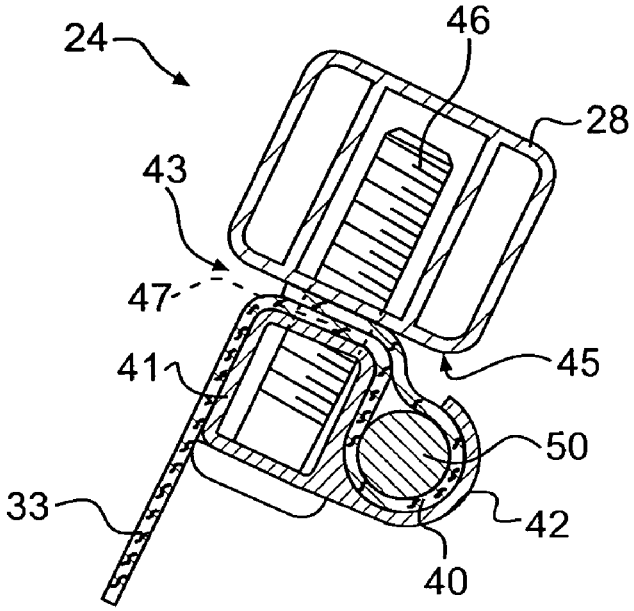
FIG. 5 is a right side cross-sectional view of the upper backrest assembly portion of one embodiment of the present invention, taken along the line V-V of FIGS. 2 and 3.

The method of securing top cross bar 28 and bottom cross bar 38 members to frame side rails 14 can be by conventional means, such as by welding or by providing the frame side rails 14 with open interior slots for receiving respective ends of top and bottom cross bar members 28, 38 (not shown). The method of securing sling fabric member 33 to top and bottom cross members involves upper 24 and lower 26 backrest assemblies. Upper backrest assembly 24 comprises at least top cross bar member 28 and detachable support bar 30. As shown in FIGS. 2, 3 and 5, detachable support bar 30 is provided with a base portion 41 and a scaffold portion 42, wherein scaffold portion 42 can be "c"-shaped as shown for receiving a substantially rigid rod 50. As shown in FIG. 5, rod 50 is placed through a loop 40 forming a lateral pocket in sling fabric member 33, wherein the sling loop 40 and rod 50 rest in the channel 88 (FIG. 7) created by scaffold portion 42. Loop 40 can be formed, for example, by bending sling fabric member 33 edge back upon itself and securing the sling fabric member 33 to itself, such as via a hem or similar method. A portion of sling fabric member 33 thus rests in the gap 43 created by the base portion 41 of support bar 30 and cross bar member 28. Thus, gap 43 is between first cross bar member 28 and support bar member 30, extending from an inside surface of each, facing a seated individual, all the way through to an outside surface of each, so that loop 40 of sling fabric member 33 may rest in scaffold portion 42. The support bar 30 can be secured to the bottom face 45 of top cross bar 28 using screws 46 mating with a first set of internal threads 47 in base portion 41 and top cross bar 28, for example. Alternative means of fastening support bar 30 to top cross bar 28 can be employed, such as sheet metal screws, hook and loop fasteners, clamps, or malleable plug members extending from support bar 30 into openings in top cross bar 28, for example.

Figure 4:
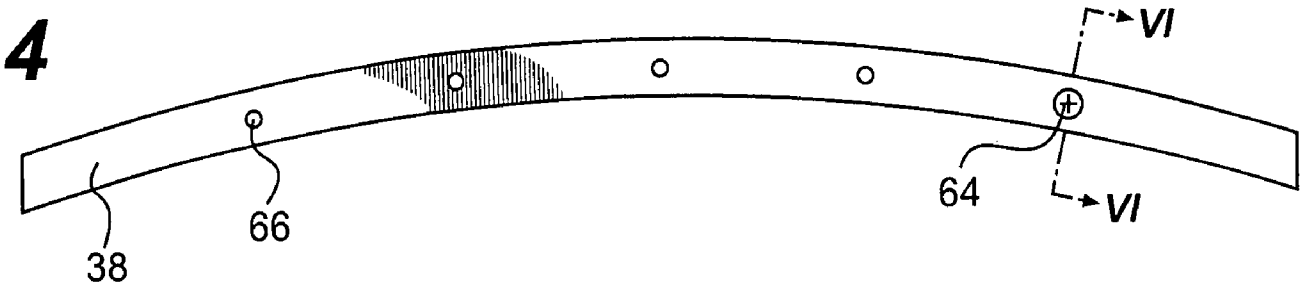
FIG. 4 is a bottom plan view of one embodiment of the bottom cross bar member of the present invention.
Figure 6:
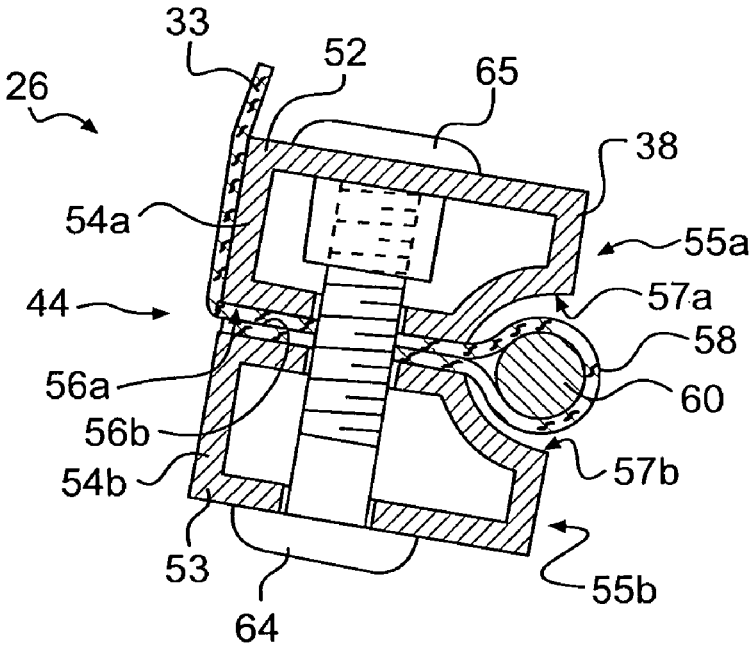
FIG. 6 is a right side cross-sectional view of the lower backrest assembly portion of one embodiment of the present invention, taken along the line VI-VI of FIG. 4.
Figure 7A:
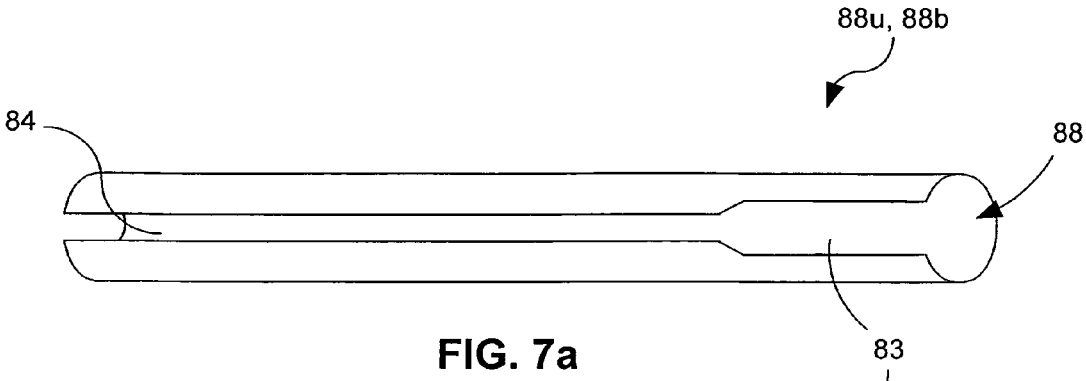
FIG. 7*a* is a perspective view of an alternative embodiment for the cross bar member.
Figure 7B:
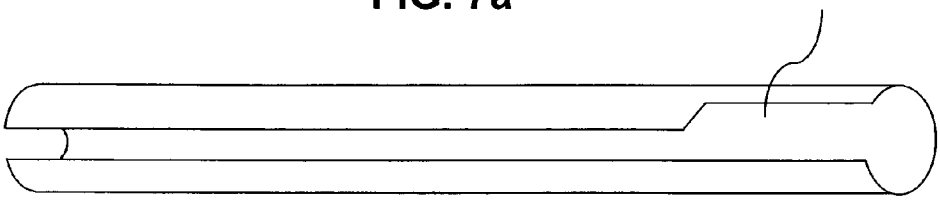
FIG. 7*b* is a perspective view of an alternative embodiment for the notch placement in the cross bar member.
Figure 7C:
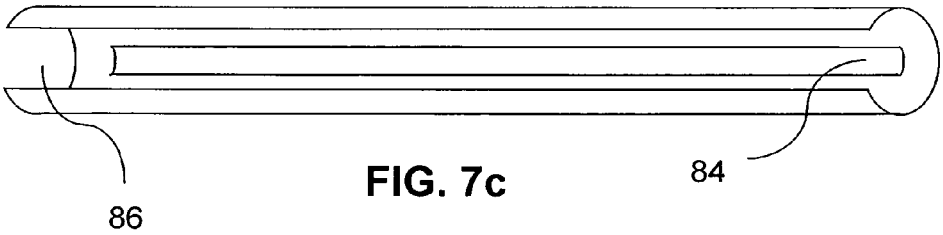
FIG. 7*c* is a perspective view of an alternative embodiment for an insertion slot placement in the cross bar member.
Figure 7D:
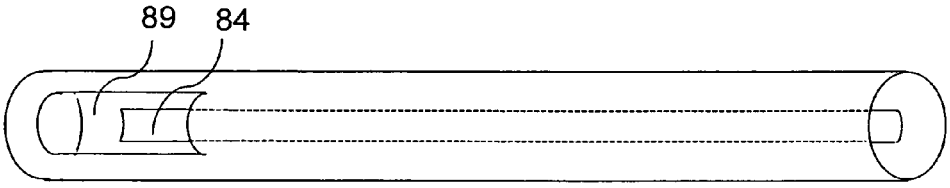
FIG. 7*d* is a perspective view of an alternative embodiment for a short insertion slot placement in the cross bar member.

As shown in FIGS. 2, 4 and 6, lower backrest assembly 26 comprises at least bottom cross bar 38 and flexible rod 60. As shown in the versions of FIGS. 2 and 6, bottom cross bar 38 can include an upper portion 52 and a lower portion 53 which join together at respective ends 38*a* and 38*b*, and which have respective inside walls 54*a* and 54*b*, outside walls 55*a* and 55*b* and interior facing walls 56*a* and 56*b*. In some versions, cross bar member 38 can be formed as a unitary, monolithic piece, or in other versions it can be formed by securing respective portions 52 and 53 together at ends 38*a* and 38*b* through welding or other attachment means. In this example, the interior facing walls 56*a* and 56*b* cooperate to form a through-and-through slot 44. In this way, slot 44 extends between the upper portion 52 and the lower portion 53 and through said second or bottom cross bar member 38. As shown in FIG. 2, slot 44 can extend for substantially the length of upper 52 and lower 53 portions. As shown in FIG. 6, the end of fabric sling member 33 opposite the end secured to upper bracket assembly is provided with a loop 58 for flexible rod 60. Loop 58 can be formed in a manner similar to that described for forming loop 40. Flexible rod 60 and sling loop portion 58 are then retained against outside walls 55*a* and 55*b*, which are respectively provided with inwardly extending portions 57*a* and 57*b* for such purpose. In one embodiment as shown in FIG. 6, inwardly extending portions 57*a* and 57*b* are arcuate in cross-section. Portions 57*a* and 57*b* assist in providing the backrest assembly 22 with a low profile, minimizing the extent of rod and sling extension outside of the plane formed by outside walls 55*a* and 55*b*, which in turn minimizes sling fabric member 33 exposure to unnecessary wear and tear. As shown in FIGS. 4 and 6, the securing of sling fabric member 33 within lower bracket assembly 26 can be optionally enhanced through the employment of one or more machine screws 64 extending through openings 66 in bottom cross bar member 38 and mated with a second set of internal threads 65 in upper portion 52, or other similar securing element. In one embodiment of the invention, a screw receiving member such as a nut having an interior threaded surface is maintained within walls of bottom cross bar 38 so as to receive machine screw 64 while not extending outwardly of the upper portion 52 of bottom cross bar 38. In this way, minimum visibility of attachment elements such as nuts and bolts can be maintained, which enhances the aesthetic qualities of the present invention.

It will be appreciated that the shape of top cross bar 28 and bottom cross bar 38 can be adapted to suit particular chair requirements in accordance with the present invention. For example, the top cross bar 28 can have a rounded rectangle cross-sectional shape, as shown in FIG. 5, or can have a square, hexagonal, octagonal or other polygonal shape. Bottom cross bar 38 can have a primarily rectangular shape with arcuate interior wall segments 57*a* and 57*b* as shown in FIG. 6 and described earlier. Alternatively, bottom cross bar 38 can have a square, hexagonal, octagonal or other polygonal shape. In one embodiment, bottom cross bar 38 has an octagonal shape and adjacent edges establish a receiving channel for substantially rigid rod 50, flexible rod 60 and loop 58 again minimizing the outward extension of the loop 58 and rod 50, flexible rod 60 beyond the lower backrest assembly 26. In a further embodiment, a metal frame member (not shown) can be secured to upper 52 and lower 53 portions of bottom cross bar 38 to conceal and protect sling fabric member 33 and loop 58.

By placing the sling fabric member 33 entrapment at the top and bottom in the top cross member 28 and bottom cross member 38, rather than in the side rails 14, the invention facilitates the creation of a comfortable concave shape to the back rest assembly 22. Also, the invention thereby allows for shorter looped hems and rods than would exist if the sling fabric member 33 were attached to the side rails 14. The invention also permits sturdier and more rigid frame 12 construction and leaves open more design possibilities for accessory items.

The method of assembling the backrest 22 to the frame 12 according to the present invention can occur in several ways. In one exemplary way, rigid frame 12 is provided with top cross bar member 28 and bottom cross bar member 38 secured to side rails 14 as shown in FIG. 2. Sling fabric member 33 is provided with loops 40, 58 at two ends thereof. Loop 58 is manipulated in through slot 44 in lower cross bar 38 so as to be positioned somewhat adjacent to wall portions 57*a* and 57*b*. Flexible rod 60 is then manipulated through loop 58 such that any tension applied to the remainder of sling fabric member 33, such as pulling on sling fabric member 33 from a location on the interior of lower cross bar member 38, will result in loop 58 contacting wall portions 57*a* and 57*b*. Machine screws 64 and nuts or equivalent attachment means can assist in retaining sling fabric member 33 in place with respect to bottom cross bar 38.

Next, rod member 50 is placed through loop 40 of sling fabric member 33, and this arrangement is positioned over base portion 41 of support bar 30 and within scaffold portion 42. Support bar 30 is then raised so as to align with the bottom face 45 of top cross bar member 28. Screws 46 or similar attachment means can then be manipulated through base portion 41, sling fabric member 33 and top cross bar member 28 to securely maintain support bar 30 and sling fabric member 33 to top cross bar member 28.

Figure 8:
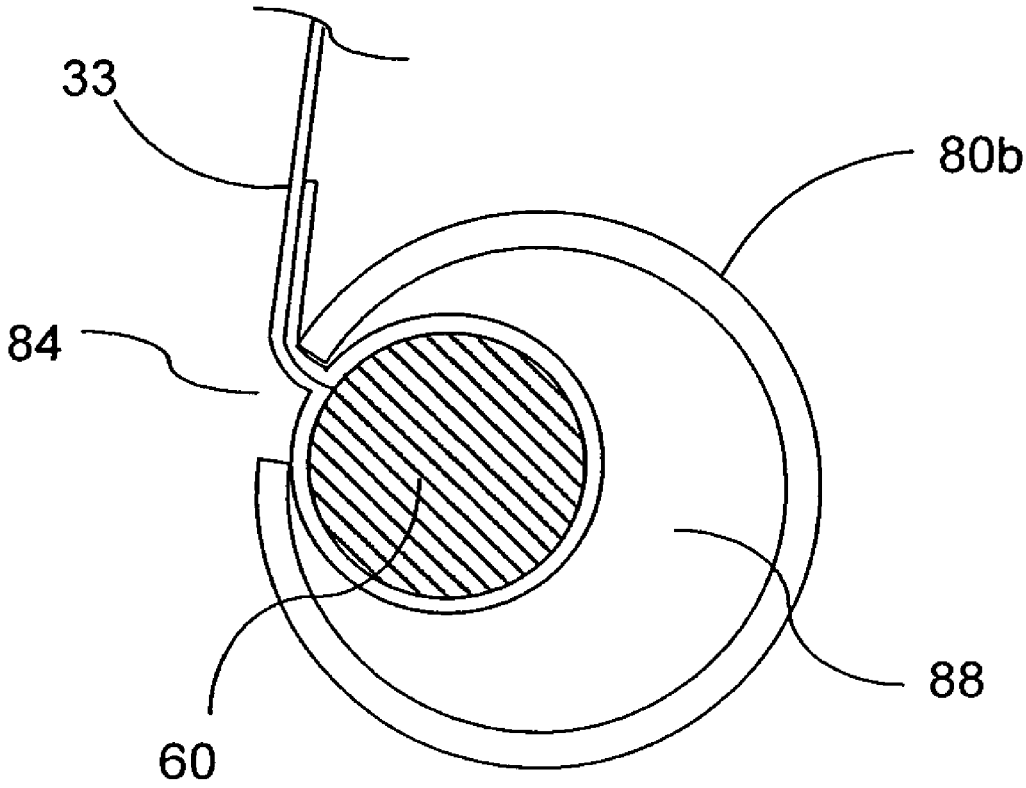
FIG. 8 is a side view of an alternative embodiment for the lower cross bar member.

In an alternative embodiment or version, lower backrest assembly 26 may have a monolithic bottom cross bar 38 formed from a single tubular piece, for which no screws are required in assembling or fixing sling fabric member 33 to bottom cross bar 38. With reference to FIGS. 7 & 8, an aspect of such an embodiment is that a tubular bottom cross bar 38 defines a internal conduit 88 or with a tubular interior and a longitudinal slot 84 opening on a face of second tubular cross bar 80 for access to internal conduit 88. In this version, the back rest assembly 22 for a sling chair 10 will involve a fabric sling member 33 having a height and width so as to form an upper end and a lower end corresponding to upper backrest assembly 24 and lower backrest assembly 26. Sling fabric member 33 includes a loop 58 across the lower end of the sling fabric member 33, with loop 58 having a loop diameter and defining at least one side pocket opening at one end. Some embodiments of sling fabric member 33 may be a strap, band, or sheet filling the entire back height and width or more than two thicknesses wide as compared to two thicknesses of the sling fabric member 33 fabric used. The sling fabric member 33 also has a loop 58 across the upper end of the sling fabric member 33 with a loop diameter, the loop 58 defining at least one side pocket opening at one end. An aspect is slot 84 running longitudinally down the face of the tubular cross bar 80, with embodiments of slot 84 as wide as at least two thicknesses of the fabric of the sling fabric member 33. This allows for the fabric of the sling fabric member 33 to be folded over upon itself forming loop 58.

Other embodiments may involve a configuration of loop 58 in which sling fabric member 33 is folded within itself, so that a single thickness is presented through the slot.

In an embodiment the present invention may have an upper cross bar 80*u* or a lower cross bar 80*b* that faces rearward as compared to the backrest assembly 22. In this manner tension of the sling fabric member 33 may be looped over the upper cross bar 80*u* to the lower cross bar 80*b* and looped under the lower cross bar 80*b* to present a backrest assembly 22 which presents an entirely sling fabric member 33 to the back of the user. In this manner the tension of the sling fabric member 33 is spread evenly across a smooth surface of the upper cross bar 80*u* and lower cross bar 80*b*. The ends of the tubular cross bar 80 may be enclosed for decorative purposes. The upper cross bar 80*u* and/or lower cross bar 80*b* may be mounted to the frame side rails 14 so that slot 84 is facing in any desired position rotationally around the longitudinal axis. The first cross bar member is attached to the side rail upper inner portions and the second cross bar member is attached to the side rail lower inner portions similar to FIG. 2.

The notch 83 may have a centerline which is congruent with the centerline of the slot 84 or may be offset so that the minimum notch 83 length and height meets the requirements as noted by the equations below.

As with other embodiments, a pair of frame side rails 14 are included, each having a front and a back face 15. A flexible rod 60 is provided for use with loop 58. Flexible rod 60 may be in a cross-section a square, rectangle, triangle or of multiple forms and has a length substantially corresponding to the length of the loop 58 and a diameter less than the diameter of the loop 58. The upper cross bar 80*u* is secured to corresponding upper portions of said side rails 14, with the upper cross bar 80*u* having a lower surface and a generally curved shape so as to project at least partially outwardly away from said respective back faces of said frame side rail 14. Likewise, a lower cross bar 80*b* is secured to corresponding lower portions of each of said frame side rail 14 and has a generally curved shape so as to project at least partially outwardly away from said respective back faces of said frame side rails 14. Lower cross bar 80*b* thus cooperates with said upper cross bar 80*u* so as to hold said frame side rails 14 in substantially parallel relation, with said lower cross bar 80*b* being substantially parallel to said upper cross bar 80*u*.

An aspect of this embodiment is that lower cross bar 80*b* is tubular and defines an internal conduit 88 with a longitudinal slot opening 84 on a face of the lower cross bar 80*b*. Slot 84 has a width that is greater than the thickness of the fabric of sling fabric member 33 and less than the diameter of the flexible rod 60; in addition, slot 84 may generally run a length at least about the width of the fabric sling member 33. An aspect of lower cross bar 80*b* is that conduit 88 has a diameter greater than the flexible rod 60 combined with twice the thickness of the fabric of the sling fabric member 33; thus, conduit is configured to retain the flexible rod 60 within the loop 58 when inserted into the conduit 88.

Lower cross bar 80*b* includes at least one access notch 83 along the longitudinal slot 84 opening into the conduit 88. This may be a widening of the slot 84 on the face of the lower cross bar 80*b* to be at least as wide as the flexible rod 60 and loop 58 assembled. The sizing and configuration of notch 83 is to be long and wide enough to enable the insertion of the loop 58 into the conduit 88 and the insertion of the flexible rod 60 into the loop 58 while the loop 58 is inserted into the conduit 88. The slot 84, notch 83 and conduit 88 of the upper cross bar 80*u* and the lower cross bar 80*b* must minimally meet the following requirements for an embodiment where the sling fabric member 33 is of a double thickness where:

$d_{rod}$=the flexible rod 60 diameter

F=thickness of the fabric sling back 33

$F_f$=thickness of the fabric sling back 33 fold when inserting the flexible rod 60 and fabric sling back 33 into the notch 83 at a maximum of 45 degrees C=compression of flexible rod 60 material when bent at 45 degrees to the conduit 88

Conduit 88 inside diameter$_{min}$=$d_{rod}$+2F

Slot 84 width$_{min}$=2F

Notch 83 width$_{min}$=$d_{rod}$+2F+($F_f$)+C $$\text{Notch 83 } length_{min} = \frac{d_{rod} + 2F}{\text{Cos}45}$$

Applying the above equations assuming:

$d_{rod}$=3 mm (nylon)

Fabric thickness=0.5 mm

Fabric compression on insertion=$F_f$=1.0 mm

Compression of rod=C=0.1 mm

Slot width=2F=2(0.5 mm)=1.0 mm

Notch width=$d_{rod}$+2F+($F_f$)+C=3+1+1+0.1=5.1 mm $$\text{Notch length} = \frac{d_{rod} + 2F}{\text{Cos}45} = \frac{3+1}{.525} = 7.6 \text{ mm}$$

Applying the above equations for a single thickness fabric assuming:

$d_{rod}$=3 mm (nylon)

Fabric thickness=0.5 mm

Fabric compression on insertion=$F_f$=1.0 mm

Compression of rod=C=0.1 mm

Slot width=F=0.5 mm Notch width=$d_{rod}$+F+($F_d$)+C=3+0.5+1+0.1=4.6 mm $$\text{Notch length} = \frac{d_{rod} + 0.5F}{\text{Cos}45} = \frac{3+0.5}{.525} = 5.8 \text{ mm}$$

Accordingly, the notch 83 is located at a point along the slot 84 corresponding to the side opening of loop 58, when the loop 58 is substantially inserted into the conduit 88. The presence of the notch 83 allows for insertion of at least a portion of the flexible rod 60 residing within the loop 58 assembly into the cross bar members 80*u*, 80*b* after assembly of the cross members 80*u*, 80*b* between the frame side rails 14. The notch 83 may be shaped as a flat where it abuts the slot 84, tapered, rounded or the flat corners folded outwardly and down perpendicular to the corner to assist in flexible rod 60 and sling fabric member 33 into channel 88.

Thus, with this embodiment no screws are needed to affix sling fabric member 33 to lower cross bar 80*b*. In this manner the flexible rod 60, and loop 58 are captured within the upper cross bar 80*u* and lower cross bar 80*b*. This eliminates the need for both support bars 30, mounting hardware to provide a slit and assembly time or tools for assembly. In practice, this results in a clean, secure fitting sling fabric member 33 that is easier to assemble.

Assembly of the sling fabric member 33 into the upper cross bar 80*u* or lower cross bar 80*b* may occur after the upper cross bar 80*u* or lower cross bar 80*b* is assembled between and to the frame side rails 14. The notch 83 may be facing forward in relation to the backrest assembly 22 or in a rearward direction allowing for insertion of the rod 50, flexible rod 60 and loop 58 from the front or rear of upper cross bar 80*u* or lower cross bar 80*b*. In a rearward facing position, the sling fabric member 33 and rod 50 may be inserted in upper cross bar 80*u*, then looped over the upper cross bar 80*u* concealing the upper cross bar 80*u* from the user facing the front of the sling chair 10. The remaining sling fabric member 33 and flexible rod 60 may be looped under the lower cross bar 80*b* and inserted into the rearward facing notch 83 of the lower cross bar 80*b*. This method conceals both the upper cross bar 80*u* and the lower cross bar 80*b* from the user facing the sling chair 10. The notch 83 allows for simple insertion of the rod 50, flexible rod 60 and loop 58 and does not need to have a size or shape to enable the manipulation of weaving wicker as described in U.S. Pat. No. 7,481,495 to Wang, et al. hereby fully incorporated by reference.

Figure 9:
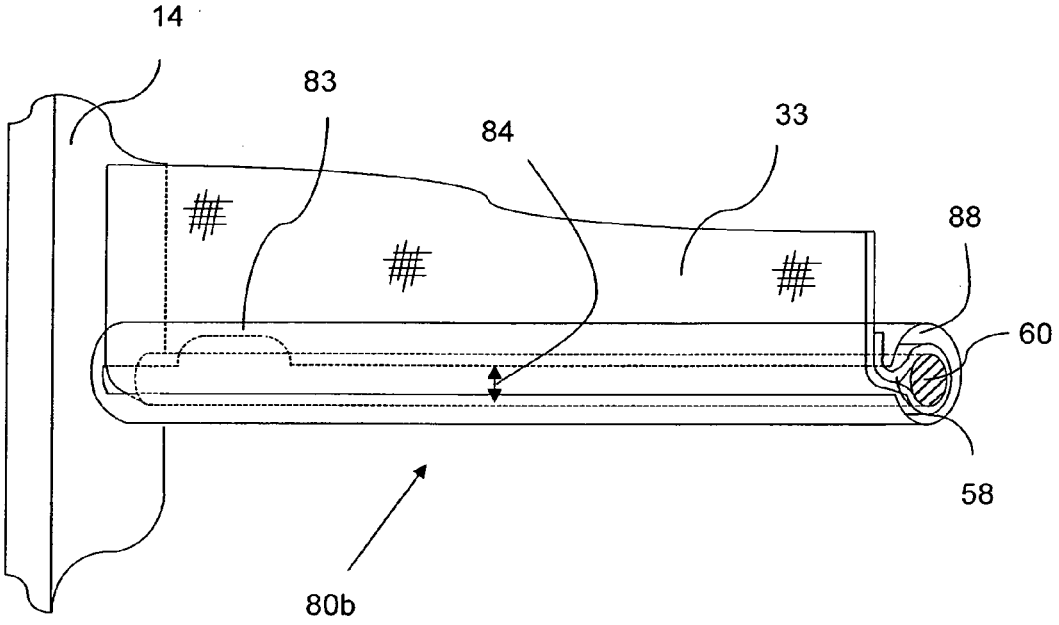
FIG. 9 is a view of the loop and rod within the lower cross bar.

It is anticipated that the maximum force for insertion depending on the flexible rod 60 and loop 58 material flexibility will be in the range of 3.4-8.4 pounds force for insertion at an angle of up to 45 degrees. As the notch 83 height becomes larger and without obstruction by other components the insertion angle will decrease and therefore decrease the required insertion force. This clean appearance may be seen by the finished product. FIG. 9 is an isometric view showing the clean appearance of the sling fabric member 33 protruding through the slot 84. As discussed above, during assembly no screws are required for lower cross bar 80*b*. Instead, loop 58 of sling fabric member 33 and flexible rod 60 are inserted into conduit 88, a much quicker and less laborious approach, reducing assembly cost and time.

In another embodiment (FIG. 7*c*) the upper cross bar 80*u* and lower cross bar 80*b* has a slot 84 from which the sling fabric material 33 protrudes from the upper cross bar 80*u* or lower cross bar 80*b*. On the opposite side of the upper cross bar 80*u* or lower cross bar 80*b* is an insertion slot 86 which has a length equal to or greater than the slot 84 and is wider than the loop 58 and flexible rod 60. In this manner the sling fabric member 33 is assembled by inserting the sling fabric member 33 through the slot 84 in an inverse manner such that the sling fabric member 33 protrudes into the conduit 88 and through the conduit 88 through the insertion slot 86 on the opposite side of the upper cross bar 80*u* or lower cross bar 80*b*. The flexible rod 60 is then inserted into the loop 58 and the sling fabric member 33 is then urged inversely from the insertion direction such that the flexible rod 60 and loop 58 then resides in the conduit 88 against the back of the slot 84. In that the flexible rod 60 and loop 58 is of a greater diameter than the width of the slot 84, the flexible rod 60 and loop 58 serve to restrict any further movement of the sling fabric member 33, thus securing the sling fabric member 33.

In yet another embodiment (FIG. 7*d*) the upper cross bar 80*u* or lower cross bar 80*b* is fashioned as described above, except it has a short insertion notch 89 has a length less than the slot 84. The short insertion notch 89 may be located at either end of the upper cross bar 80*u* or lower cross bar 80*b*. The sling fabric member 33 is inserted into the slot 84 in an inverse direction into the conduit 88 where it remains within the conduit in a longitudinal direction. The end of the loop 58, is then located and flexible rod 60 is inserted into the loop 58 through the short insertion notch 89. As in the manner noted above, the sling fabric member 33 is then pulled inversely from the insertion direction where the flexible rod 60 located within the loop 58 constrain the sling fabric member 33 from pulling back through the slot 84.

FIG. 8 is a sectional view showing the lower cross bar 80*b* with the flexible securing flexible rod 60 inside the loop 58 and contained within the conduit 88. In this embodiment the loop 58 is at the respective end 38*b* of the sling fabric member 33. Two layers of the fabric of the sling fabric member 33 are shown protruding through the slot 84.

FIG. 9 is an isometric view depicting the lower cross bar 80*b* showing in detail the mating of the lower cross bar 80*b* to one of the side rails 14. Also shown in this figure is the location of the notch 83 in relation to the slot 84. The lower cross bar 80*b* may be rotated around the longitudinal axis in order to locate the slot 84 in a desired position. A double thickness of the fabric of the sling fabric member 33 are shown protruding through the slot 84 although the flexible rod 60 may be within the loop 58 where only one thickness of the fabric protrudes through the slot 84. The notch 83 is medially from the end of slot 84, but not at the end of slot 84. Medially is defined as lying or extending toward the middle, more specifically not abutting the end of the slot or cross bar. This allows for the flexible rod 60 and loop 58 to be retained by the closed end of the internal conduit 88.

Figure 10:
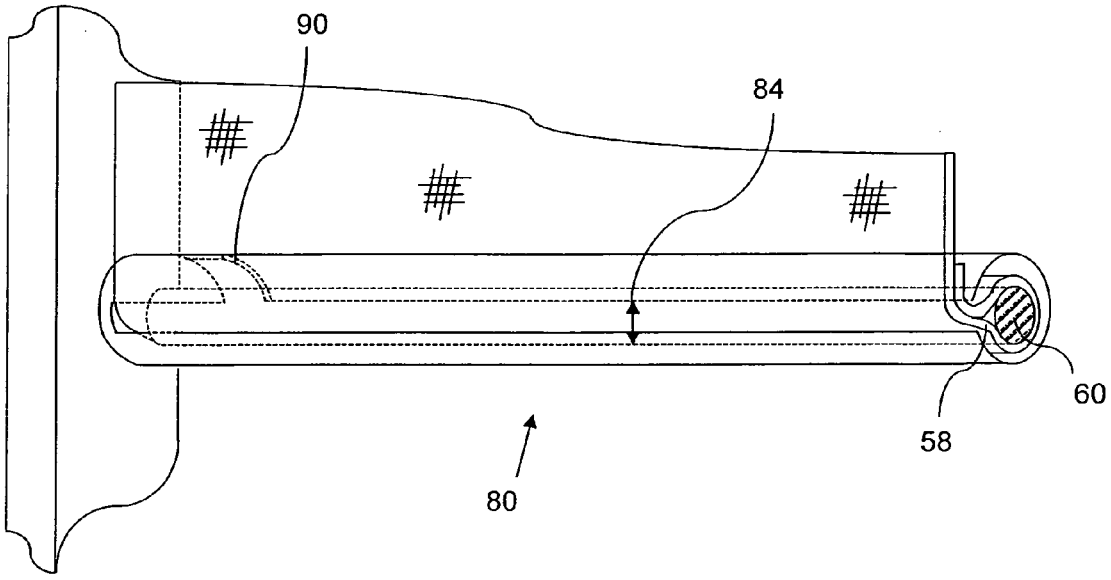
FIG. 10 is a view of the wing notch within the lower cross bar.

FIG. 10 shows a view of a wing notch 90 within a tubular cross bar 80. Wing notch 90 does not reside axially along the slot 84, but is angled following the contour of the tubular cross bar 80. This allows for insertion of the flexible rod 60 within the loop 58 to be inserted at an angle assisting in manufacturability.

Figure 11:
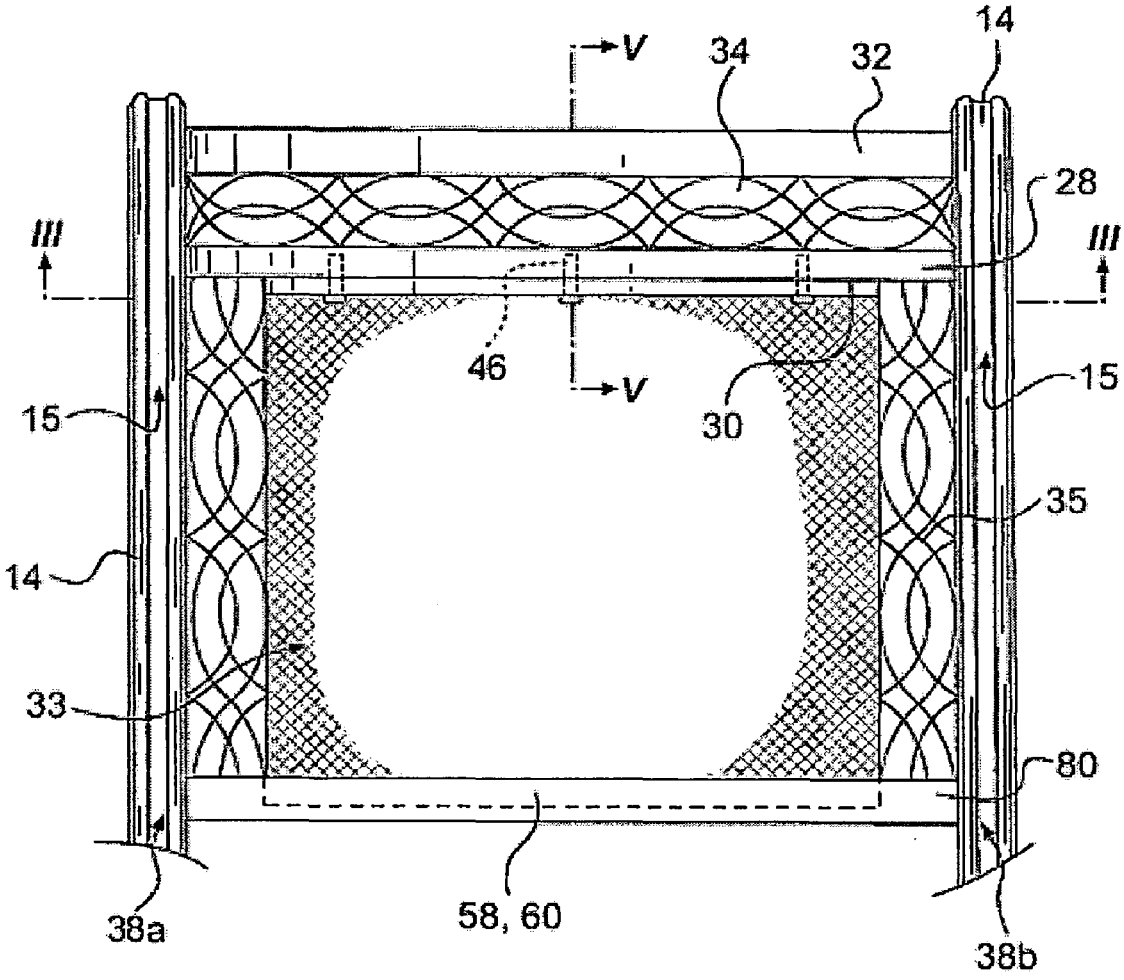
FIG. 11 is a view of the rear of the chair with the present invention as the lower cross bar.

FIG. 11 shows a rear view of a sling back chair 10 with the lower cross bar 80*b* securing the sling fabric member 33 to the lower portion of the frame side rails 14, thus in combination with the top cross bar member 28 forming a sling fabric member back rest surface.

In another embodiment the sling fabric member 33 including the flexible rod 60 and loop 58 may be removed from the cross bar members 80*u*, 80*b* through the notch 83. The sling fabric member 33 may then be removed from the flexible rod 60 and replaced with a sling fabric member 33 of a different pattern, color, size or shape.

Upper backrest assembly 24 may take the form of any of the variations described above. For example, a support bar 30 may be secured to said top cross bar 28, with said support bar 30 having an upper surface and being substantially curved so as to extend in an arc pattern substantially similar to said top cross bar 28, said support bar 30 member being secured such that a gap is created between the lower surface of the top cross bar 28 and the upper surface of the support bar 30 extending from an inside surface of each all the way through to an outside surface of each. In additions, the other variations described above may used with this embodiment, as applicable.

In any embodiment, upper cross bar 80*u* or lower cross bar 80*b* may be paired with top cross bar 28 or bottom cross bar 38 such that any embodiment involving upper cross bar 80*u* may have a bottom cross bar 38 or any lower cross bar 80*b* may have a top bar 28.

The process to assemble the chair back are:

1) Attaching the first cross bar member and the second cross bar member to the first side rail end portion and the second side rail end portion so that the first and second cross bars are generally parallel to each other and perpendicular to the frame side rails.

2) The first flexible securing rod is fully inserted within the first loop of the sling fabric member.

3) The first flexible securing rod inside the first loop of the sling fabric member is inserted into the first notch of the first cross bar member and into the first internal conduit such that the sling fabric extends through the slot.

4) The first flexible securing rod and the first loop are fully positioned in the first internal conduit such that the fabric extends the length of the slot;

5) The sling fabric member second edge is pulled toward the second cross bar member extending to the second cross bar member with sufficient material to be secured to the second cross bar member.

6) The sling fabric member second edge is then secured to the second cross bar member.

In an alternative embodiment, the second cross bar member is shaped like the first and would employ the same steps as shown in paragraph [0046] continuing from step 5 and alternative steps 6 and 7.

6). providing the second flexible securing rod having a length substantially corresponding to the length of the second loop and a rod diameter less than the diameter of the second loop and inserting the second flexible securing rod within the second loop of the sling fabric member;

7). inserting the second flexible securing rod and the second loop of the sling fabric member into the second notch of the second cross bar member into the second internal conduit such that the sling fabric extends through the slot; and positioning the second flexible securing rod and the second loop fully in the second internal conduit such that the fabric extends the length of the slot.

Simply put, and in reference to FIG. 9, the chair back has at least two side rails 14 placed approximately vertical and substantially parallel to each other. A sling fabric member 33 is preassembled having a first loop 58 along a first edge and a second loop 58 along a second edge, the first loop 58 being substantially the length of the first edge and of a desired loop diameter and the second loop 58 being substantially the length of the second edge and of the desired loop diameter. The both loops 58 run the length of the sling fabric member 33 parallel to each other.

There is least one flexible rod 60 which can be used at times interchangeably with any crossbar 80 of the same configuration. The flexible rod 60 has a diameter smaller than the desired loop diameter in order to fit inside the loop 58. Should two cross members 80*u*, 80*b* be used in the construction of the chair 10 there would be a first flexible securing rod and a second flexible securing rod.

The first flexible rods 60 are the length of the first edge and is inserted within the first loop 58, and the second flexible rod 60 is the length of the second edge and is inserted within the second loop 58.

There is at least one cross bar 80 having a hollow conduit 88, a longitudinal slot 84 substantially the length of the cross bar 80, the slot 84 having a width greater than twice the thickness of the sling fabric member 33, the slot 84 width less than the diameter of the flexible rod 60 and loop 58, with a notch 83 widening the slot 84 axially shown at the left end of FIG. 9. The width of the notch 83 is minimally greater than the diameter of the flexible rod 60 and desired loop diameter and the length approximately twice the width.

There is at least a first cross bar 80 and a support bar 28, 38 (shown in FIG. 5 or FIG. 6) or possibly a second cross bar 80 (80*b* and/or 80*u*) attached horizontally between the side rails 14 and generally parallel to each other. The first loop 58 and first flexible rod 60 are inserted in the first cross bar 80 notch 83 and urged completely into the conduit 88 with the sling fabric member 33 protruding through the slot 84 and the second loop 58 and second flexible rod 60 are inserted in the second cross bar 80 notch 83 and urged completely into the conduit 88 with the sling fabric member 33 protruding through the slot 84 forming a sling fabric member back rest surface.

It is noted that the sling fabric member back rest surface retains a tension when an applied pressure of 15 kilograms is applied over a single 5 cm square area to the sling fabric member back rest surface plane at approximately a midpoint between the side rails where the force applied deflects the sling fabric member surface from 0.5 cm to 30 cm.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. A back for a sling chair, comprising:

a sling fabric member having a height, a width, an upper end, and a lower end, the sling fabric member having a lateral pocket lower loop across the lower end of the sling with a lower loop diameter, the lower loop defining at least one side pocket opening at one end and a lateral pocket upper loop across the upper end of the sling fabric member with an upper loop diameter, the upper loop defining at least one side pocket opening at one end;

a pair of frame side rail members, each having a front and a back face;

a first flexible rod having a length substantially corresponding to the length of the lower loop and a rod diameter less than the diameter of the lower loop;

a second flexible rod having a length substantially corresponding to the length of the upper loop and a rod diameter less than the diameter of the upper loop;

a lower cross bar secured to corresponding lower portions of each of the frame side rails and cooperating with an upper cross bar member so as to hold said frame side rail members in substantially parallel relation, said lower cross bar being substantially parallel to said upper cross bar member, said lower cross bar being tubular and having a generally curved shape so as to project at least partially outwardly away from said respective back faces of the frame side rails, the lower cross bar defining a lower internal conduit and a longitudinal slot opening on a face of the lower cross bar member into the lower internal conduit;

the upper cross bar secured to corresponding upper portions of the frame side rail members, the upper cross bar having a lower surface and a generally curved shape so as to project at least partially outwardly away from the respective back faces of the frame side rails the upper cross bar defining an upper internal conduit and a longitudinal slot opening on a face of the upper cross bar member into the upper internal conduit;

wherein the slot in the lower cross bar has a width that is greater than the thickness of the fabric of the sling fabric member and less than the diameter of the first flexible rod, the slot in the lower cross bar further having a length at least about equal to a lateral length of the sling fabric member;

wherein the lower internal conduit has a diameter greater than the first flexible rod and twice the thickness of the fabric of the sling fabric member, the lower internal conduit thus being configured to retain the first flexible rod within the lower loop when inserted into the lower internal conduit;

wherein the lower cross bar further comprises at least one lower insertion notch opening into the lower internal conduit;

wherein the lower notch is at least as wide as the diameter of the first flexible rod within the lateral pocket lower loop, and further wherein the lower notch is long and wide enough to enable the insertion of at least a portion of the first flexible rod within the lower loop of the sling fabric member into the lower internal conduit;

wherein the slot in the upper cross bar has a width that is greater than the thickness of the fabric of the sling fabric member and less than the diameter of the second flexible rod, the slot in the upper cross bar further having a length at least about equal to the lateral length of the sling fabric member;

wherein the upper internal conduit has a diameter greater than the second flexible rod and twice the thickness of the fabric of the sling fabric member, the upper internal conduit thus being configured to retain the second flexible rod within the upper loop when inserted into the upper internal conduit; and wherein the upper cross bar further comprises at least one upper insertion notch opening into the upper internal conduit, wherein the upper notch is at least as wide as the diameter of the second flexible rod within the lateral pocket upper loop, and further wherein the upper notch is long and wide enough to enable the insertion of at least a portion of the second flexible rod within the upper loop of the sling fabric member into the upper internal conduit.

2. The back for a sling chair of claim 1, wherein the upper notch is along the slot in the upper cross bar opening into the upper internal conduit, the upper notch formed by a widening of the slot on the face of the upper cross bar member, the notch of a width and length that allows for insertion of the sling fabric member upper loop into the conduit of the upper cross bar while the second flexible rod is inserted within the sling fabric member upper loop, and the lower notch is along the slot in the lower cross bar opening into the lower internal conduit, the lower notch formed by a widening of the slot on the face of the lower cross bar member, the lower notch of a width and length allowing for insertion of the sling fabric member lower loop into the conduit of the lower cross bar while the first flexible rod is inserted within the sling fabric member lower loop.

3. The back of a sling chair of claim 1, wherein the width of the upper slot is greater than two or more thicknesses of the fabric of the sling fabric member, and the thickness of a portion of the sling fabric member passing through the upper slot comprises two or more thicknesses of the fabric.

4. The back of a sling chair of claim 1, wherein at least a portion of the sling fabric member is elastic.

5. The back of a sling chair of claim 1, wherein the first flexible rod and the second flexible rod have circular cross sections.

6. The back of a sling chair of claim 1, wherein the upper cross bar and the lower cross bar are substantially c-shaped in cross-section.

7. The back of a sling chair of claim 1, wherein the upper notch is long and wide enough to enable the removable insertion of at least a portion of the second flexible rod within the upper loop of the sling fabric member into the upper internal conduit.

8. The back of a sling chair of claim 1, wherein the upper notch of the upper cross bar is symmetrical about the length of the upper slot.

9. The back of a sling chair of claim 1, wherein the lower notch of the lower cross bar is symmetrical about the length of the lower slot.

10. The back of a sling chair of claim 1, wherein the upper cross bar comprises an upper insertion notch on a side opposing the face having the upper slot, the upper insertion notch having a length equal to or greater than the length of the upper slot and a width wider than the width of the upper loop with the second flexible rod inserted within the upper loop, wherein the sling fabric member may be passed through the upper slot and at least a portion of the upper loop may be exposed at the upper notch, such that the second flexible rod may be inserted through the upper insertion notch and urged into the upper loop, securing the sling fabric member into the upper conduit.

11. The back of a sling chair of claim 1, wherein the upper cross bar comprises an upper insertion notch on a side opposing the face having the upper slot, the upper insertion notch having a length less than the length of the upper notch and a width wider than the width of the upper loop with the second flexible rod inserted within the upper loop, wherein the sling fabric member may be passed through the upper slot and at least a portion of the upper loop may be exposed at the upper notch, such that the second flexible rod may be inserted through the upper insertion notch and urged into the upper loop, securing the sling fabric member into the upper conduit.

12. The back of a sling chair of claim 1, wherein the lower cross bar comprises a lower insertion notch on a side opposing the face having the lower slot, the lower insertion notch having a length equal to or greater than the length of the lower slot and a width wider than the width of the lower loop with the first flexible rod inserted within the lower loop, wherein the sling fabric member may be passed through the lower slot and at least a portion of the lower loop may be exposed at the lower notch, such that the first flexible rod may be inserted through the lower insertion notch and urged into the lower loop, securing the sling fabric member into the lower conduit.

13. The back of a sling chair of claim 1, wherein the lower cross bar comprises a lower insertion notch on a side opposing the face having the lower slot, the lower insertion notch having a length less than the length of the lower slot and a width wider than the width of the lower loop with the first flexible rod inserted within the lower loop, wherein the sling fabric member may be passed through the lower slot and at least a portion of the lower loop may be exposed at the lower notch, such that the first flexible rod may be inserted through the lower insertion notch and urged into the lower loop, securing the sling fabric member into the lower conduit.

14. A back for a sling chair comprising;

a sling fabric member having a height, a width, a first end with a first edge, and a second end with a second edge, the sling fabric member having a lateral pocket loop across the first end of the sling with a first loop diameter, the first loop defining at least one side pocket opening at one loop end;

a pair of frame side rail members, each having a first side rail end portion, a second side rail end portion, a front face, and a back face;

a first cross bar member and a second cross bar member;

the first cross bar member secured to corresponding first portions of each of the frame side rail members and cooperating with the second cross bar member so as to hold said frame side rail members in substantially parallel relation, said first cross bar being substantially parallel to said second cross bar member, said first cross bar being tubular and having a generally curved shape so as to project at least partially outwardly away from said respective back faces of the frame side rails, the first cross bar defining an internal conduit and a longitudinal slot opening on a face of the first cross bar member into a first internal conduit;

wherein the sling fabric member second edge is detachably secured to the second cross bar member and the sling fabric member first edge is detachably secured to the first cross bar member;

a flexible rod having a length substantially corresponding to the length of the first loop and a rod diameter less than the diameter of the first loop;

wherein the slot on the face of the first cross bar has a width that is greater than the thickness of the fabric of the sling fabric member and less than the diameter of the first flexible rod, the slot in said first cross bar further having a length at least about equal to a the lateral length of the sling fabric member;

wherein the first internal conduit of the first cross bar has a diameter greater than the flexible rod and twice the thickness of the fabric of the sling fabric member, the first internal conduit thus being configured to retain the first flexible rod within a lateral pocket first loop of the sling fabric member when inserted into the first internal conduit;

wherein the first cross bar further comprises at least one first notch along the slot in the first cross bar opening into the first internal conduit, the first notch formed by a widening of the slot on the face of the first cross bar member;

wherein the first notch is at least as wide as the diameter of the first flexible rod within the lateral pocket first loop, and further wherein the first notch is long and wide enough to enable the insertion of at least a portion of the first flexible rod within the first loop of the sling fabric member into the first internal conduit.

15. The back for a sling chair of claim 14, wherein the minimum notch length L is calculated according to the following:

$$L = \frac{(d_{rod} + 2F)}{\cos(45°)}.$$

16. The back for a sling chair of claim 14, wherein the width of the first slot is greater than two or more thicknesses of the fabric of the sling fabric member.

17. The back for a sling chair of claim 14, wherein at least a portion of the sling fabric member is elastic.

18. The back for a sling chair of claim 14, wherein the first cross bar is substantially c-shaped in cross-section.

19. The back for a sling chair of claim 14, wherein the first notch in the first cross bar is long and wide enough to enable the removable insertion of at least a portion of the first flexible rod within the first loop of the sling fabric member into the first internal conduit.

20. The back for a sling chair of claim 14, wherein the first cross bar comprises a first insertion notch on a side opposing the face having the slot, the first insertion notch having a length equal to or greater than the length of the slot and a width wider than the width of the first loop with the first flexible rod inserted within the first loop, wherein the sling fabric member may be passed through the slot and at least a portion of the first loop may be exposed at the first notch, such that the first flexible rod may be inserted through the first insertion notch and urged into the first loop, securing the sling fabric member into the first conduit.

21. The back for a sling chair of claim 14, wherein the first cross bar comprises an first insertion notch on a side opposing the face having the slot, the first insertion notch having a length less than the length of the slot and a width wider than the width of the first loop with the first flexible rod inserted within the upper loop, wherein the sling fabric member may be passed through the slot and at least a portion of the first loop may be exposed at the first notch, such that the first flexible rod may be inserted through the first insertion notch and urged into the first loop, securing the sling fabric member into the first conduit.

22. The back for a sling chair of claim 14, wherein the second cross bar member comprises a support member detachably secured across the length of the second cross bar member, wherein the sling fabric member second edge is secured.

23. A method of assembling a chair back, comprising the steps of providing a sling fabric member having a height, a width, a first end with a first edge, and a second end with a second edge, the sling fabric member having a lateral pocket loop across the first end of the sling with a first loop diameter, the first loop defining at least one side pocket opening at one loop end;

providing a pair of frame side rail members, each having a first side rail end portion, a second side rail end portion, a front face, and a back face;

providing a first cross bar member and a second cross bar member, wherein the first cross bar member is adapted to be secured to corresponding first portions of each of the frame side rail members and cooperating with the second cross bar member so as to hold said frame side rail members in substantially parallel relation, said first cross bar being substantially parallel to said second cross bar member, said first cross bar being tubular defining an internal conduit and a longitudinal slot opening on a face of the first cross bar member into a first internal conduit, the first internal conduit of the first cross bar having a diameter greater than a first flexible rod and twice the thickness of the fabric of the sling fabric member, the first internal conduit thus being configured to retain the first flexible rod within a lateral pocket first loop of the sling fabric member when inserted into the first internal conduit;

wherein the first cross bar further comprises at least one first notch along the slot in the first cross bar opening into the first internal conduit, the first notch formed by a widening of the slot on the face of the first cross bar member and is at least as wide as the diameter of the first flexible rod within the lateral pocket first loop, the first notch being long and wide enough to enable the insertion of at least a portion of the first flexible rod within the first loop of the sling fabric member into the first internal conduit;

wherein the slot on the face of the first cross bar has a width that is greater than the thickness of the fabric of the sling fabric member and less than the diameter of the first flexible rod, the slot in said first cross bar further having a length at least about equal to a lateral length of the sling fabric member;

providing the sling fabric member second edge to be detachably secured to the second cross bar member and the sling fabric member first edge to be detachably secured to the first cross bar member;

providing at least flexible securing rod, the at least one flexible rod comprising a first flexible rod having a length substantially corresponding to the length of the first loop and a rod diameter less than the diameter of the first loop and inserting the first flexible rod within the first loop of the sling fabric member;

attaching the first cross bar member to upper inner portions of the frame side rail members;

attaching the second cross bar member to lower inner portions of the frame side rail members;

inserting the first flexible rod and the first loop of the sling fabric member into the first notch of the first cross bar member into the first internal conduit such that the sling fabric extends through the slot;

positioning the first flexible rod and the first loop fully in the first internal conduit such that the fabric extends the length of the slot;

extending the sling fabric member second edge to the second cross bar member; and securing the sling fabric member second edge to the second cross bar member.

24. The method of assembling a chair back of claim 23, wherein the at least one flexible rod comprises a second flexible rod;

wherein the second cross bar member is tubular comprising an internal conduit and a longitudinal slot opening on a face of the second cross bar member into a second internal conduit, the second internal conduit of the second cross bar having a diameter greater than a second flexible rod and twice the thickness of the fabric of the sling fabric member, the second internal conduit thus being configured to retain a second flexible rod within a lateral pocket second loop of the sling fabric member when inserted into the second internal conduit;

wherein the second cross bar further comprises at least one second notch along the slot in the second cross bar opening into the second internal conduit, the second notch formed by a widening of the slot on the face of the second cross bar member and is at least as wide as the diameter of the second flexible rod within the lateral pocket second loop, the second notch being long and wide enough to enable the insertion of at least a portion of the second flexible rod within the second loop of the sling fabric member into the second internal conduit; and wherein the slot on the face of the second cross bar has a width that is greater than the thickness of the fabric of the sling fabric member and less than the diameter of the second flexible rod, the slot in said second cross bar further having a length at least about equal to the lateral length of the sling fabric member.

25. The method of assembling a chair back of claim 24, further comprising the steps of;

providing the second flexible rod having a length substantially corresponding to the length of the second loop and a rod diameter less than the diameter of the second loop and inserting the second flexible rod within the second loop of the sling fabric member;

inserting the second flexible rod and the second loop of the sling fabric member into the second notch of the second cross bar member into the second internal conduit such that the sling fabric extends through the slot; and positioning the second flexible rod and the second loop fully in the second internal conduit such that the fabric extends the length of the slot.

26. The method of assembling a chair back of claim 23, wherein the first cross bar member and second cross bar member defining a generally curved shape so as to project at least partially outwardly away from said respective back faces of the frame side rails.

27. A chair back comprising;

at least two side rails, each having a first side rail end portion and a second side rail portion;

a sling fabric member comprising a first and second edge, with a loop along the first edge, the loop being substantially the length of the first edge and of a desired loop diameter;

at least one flexible rod of a diameter smaller than the desired loop diameter;

wherein the at least one flexible rod is adapted to be at least partially inserted within the loop;

a first cross bar defining an internal conduit, a longitudinal slot along the length of the cross bar opening into the internal conduit, the slot having a minimum width at least greater than the thickness of the sling fabric member, and a maximum width less than the diameter of the at least one flexible rod and twice the thickness of the sling fabric member, and a notch formed by widening of the slot width axially along the slot;

wherein the width of the notch is greater than the diameter of the flexible rod and twice the thickness of the sling fabric member and the desired notch length is twice the width;

a second cross bar;

wherein the first cross bar is attachable to the first side rail end portion and the second cross bar is attachable to the second side rail end portions, in spatial relation to each other; and wherein the flexible rod and loop are adapted to be at least partially inserted in the first cross bar notch and urged completely into the internal conduit such that the sling fabric member protrudes through the slot and the second edge is adapted to be detachably secured to the second cross bar, thereby forming at least a portion of the chair back.

28. The chair back of claim 27, wherein the sling fabric member defines an unloaded sling fabric member back rest surface plane; and wherein the sling fabric member has a height and a width, and is comprised of a desired fabric such that when a force of 15 kilograms is applied over a single 5 cm square area of the sling fabric member at a point approximately midpoint between the side rails the sling fabric member deflects from about from 0.5 cm to about 30 cm from the unloaded sling fabric member back rest surface plane.

29. The chair back of claim 27, wherein the at least one flexible rod is about the length of the first edge.

30. The chair back of claim 27, wherein the slot is a minimum width greater than twice the thickness of the sling fabric member.

31. The back for a sling chair of claim 27, wherein the minimum notch length L is calculated according to the following:

$$L = \frac{(d_{rod} + 2F)}{\cos(45°)}.$$

32. The chair back of claim 27, wherein the length of the slot is less than the length of the cross bar.

33. The chair back of claim 27, wherein the notch is located medially from the end of the slot.

* * * * *